US010128618B1

(12) United States Patent
Briant et al.

(10) Patent No.: US 10,128,618 B1
(45) Date of Patent: Nov. 13, 2018

(54) ELECTRICAL CONNECTOR MODULE ASSEMBLY WITH SHIELDING ELEMENTS

(71) Applicant: TE CONNECTIVITY CORPORATION, Berwyn, PA (US)

(72) Inventors: Eric David Briant, Dillsburg, PA (US); Leo Joseph Graham, Hershey, PA (US); Emilio Cuesta, Middletown, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/688,088

(22) Filed: Aug. 28, 2017

(51) Int. Cl.
*H01R 13/6581* (2011.01)
*H01R 13/66* (2006.01)
*H01R 13/04* (2006.01)

(52) U.S. Cl.
CPC ..... *H01R 13/6581* (2013.01); *H01R 13/04* (2013.01); *H01R 13/66* (2013.01)

(58) Field of Classification Search
CPC ..... H01R 13/6581; H01R 13/04; H01R 13/66
USPC ..... 439/607.55
See application file for complete search history.

(56) References Cited

U.S. PATENT DOCUMENTS 3,442,311 A * 5/1969 Rhyne ..... B27F 1/00 144/354
3,791,002 A * 2/1974 Lampe ..... B29C 67/20 29/407.09
5,799,452 A * 9/1998 Moore ..... E04B 1/2604 52/233
6,029,416 A * 2/2000 Andersson ..... E04B 1/6133 403/354
6,295,778 B1 * 10/2001 Burt ..... E04B 1/12 52/233
6,357,194 B1 * 3/2002 Jones, Jr. ..... F16B 12/125 248/223.41
6,581,351 B2 * 6/2003 DeVivi ..... E04F 15/04 403/334
6,692,808 B2 * 2/2004 Bristow ..... F16B 12/125 428/58
7,341,099 B2 * 3/2008 Kaimura ..... B21B 1/227 165/177
7,654,401 B2 * 2/2010 Obergoenner ..... B65D 9/04 217/65
7,857,636 B2 * 12/2010 Su ..... H01R 13/502 439/76.1
7,883,341 B2 2/2011 Lang et al.
7,922,536 B2 * 4/2011 Zhang ..... H01R 13/6583 439/607.45
8,282,417 B2 * 10/2012 Xiao ..... H01R 13/648 439/607.36
8,375,674 B2 * 2/2013 Braun ..... E04F 15/02 52/588.1

(Continued)

*Primary Examiner* — Alexander Gilman

(57) ABSTRACT

An electrical connector module assembly is provided and includes a first shell and a second shell configured to mate together with the first shell along an interface that extends along a portion of the shells. The first and second shells form a cavity therebetween that extends along the length of the shells. The cavity is configured to hold an electrical component therein. The module assembly also includes a plurality of shielding elements positioned along the portion of the shells. The shielding elements are configured to form a seal along the interface that shields the electrical component from electromagnetic interference.

20 Claims, 3 Drawing Sheets

(56) References Cited

U.S. PATENT DOCUMENTS

| | | | | |
|---|---|---|---|---|
| 8,516,766 | B2 * | 8/2013 | Kuznetsov | E04F 13/18 52/588.1 |
| 9,088,108 | B2 * | 7/2015 | Zhao | H01R 13/6581 |
| 9,231,344 | B1 * | 1/2016 | Liao | H01R 23/02 |
| 2003/0041545 | A1 * | 3/2003 | Stanchfield | E04F 15/02 52/592.1 |
| 2004/0132341 | A1 * | 7/2004 | Noguchi | H01R 13/6582 439/607.56 |
| 2004/0139680 | A1 * | 7/2004 | Hambright | E04B 2/06 52/578 |
| 2007/0294967 | A1 * | 12/2007 | Posselt | E04B 2/702 52/233 |
| 2010/0130063 | A1 * | 5/2010 | Lang | H01R 13/6658 439/607.17 |
| 2011/0130019 | A1 * | 6/2011 | Lim | H01R 12/7047 439/218 |
| 2011/0203213 | A1 * | 8/2011 | Dzigava | B44C 1/28 52/588.1 |
| 2015/0270649 | A1 * | 9/2015 | Blazek | H01R 13/6599 439/607.02 |
| 2016/0134056 | A1 * | 5/2016 | Chen | H01R 13/642 439/217 |
| 2016/0170162 | A1 | 6/2016 | Pan et al. | |
| 2017/0162975 | A1 * | 6/2017 | Tsai | H01R 13/5202 |

* cited by examiner

ELECTRICAL CONNECTOR MODULE ASSEMBLY WITH SHIELDING ELEMENTS

BACKGROUND OF THE INVENTION

The subject matter herein relates generally to pluggable module assemblies that are configured to limit and/or prevent electromagnetic interference (EMI).

Pluggable module assemblies allow users of electronic equipment or external devices to transfer data to or communicate with other equipment and devices. The operation and performance of module assemblies and other electronic circuitry can be interrupted, obstructed, or otherwise degraded by EMI from nearby module assemblies and/or electronic circuitry. For instance, module assemblies are generally constructed according to established standards for size and compatibility (e.g., Small Form-factor Pluggable (SFP), XFP, Quad Small Form-factor Pluggable (QSFP) or Micro Quad Small Form-factor Pluggable (MicroQSFP)). The XFP, QSFP, and MicroQSFP standards require that the module assemblies be capable of transmitting data at high rates, such as 28 gigabits per second. As the signal transmission rates increase, the circuitry within the module assemblies generates larger amounts of electromagnetic energy at shorter wavelengths, which increases the likelihood for electromagnetic energy passing through any seams or gaps formed by the module assemblies. Thus, adjacent module assemblies may experience more EMI, which can interrupt, obstruct, or otherwise degrade or limit the effective performance of the module assemblies and/or nearby circuitry.

Thus, there is a need for electrical connector module assemblies to possess high electromagnetic shielding performance to limit and/or prevent EMI.

BRIEF DESCRIPTION OF THE INVENTION

In one embodiment, an electrical connector module assembly is provided and includes a first shell and a second shell configured to mate together with the first shell along an interface that extends along a portion of the shells. The first and second shells form a cavity therebetween that extends along a length of the shells. The cavity is configured to hold an electrical component therein. The module assembly also includes a plurality of shielding elements positioned along the portion of the shells. The shielding elements are configured to form a seal along the interface that shields the electrical component from electromagnetic interference.

Optionally, the module assembly also includes a plurality of slots, each slot having inwardly tapered sidewalls connected by an interior wall, and a plurality of pins, each pin having arcuate side surfaces configured to mate with the tapered sidewalls of a corresponding slot at a point of contact. Optionally, wherein the sidewalls of each slot bias the corresponding pin towards the interior wall of the slot. Optionally, wherein the sidewalls of each slot are positioned at an angle of about 60° to about 80° relative to the interior wall. Optionally, wherein each pin includes a planar interior surface and a planar exterior surface. Optionally, the module assembly having a second plurality of slots positioned along a second portion of the first shell, and a second plurality of pins positioned along a second portion of the second shell. Optionally, wherein the first mating surface and second mating surface are positioned posterior to the pins. Optionally, wherein the plurality of pins are spaced apart from each other by a distance of about 2 millimeters or less. Optionally, the first shell having a first mating surface extending the length of the first shell, and the second shell having a second mating surface extending the length of the second shell and configured for mating with the first mating surface. Optionally, wherein the first and second shells comprise a material configured to block electromagnetic interference from entering the assembly.

In another embodiment, an electrical module assembly is provided. The module assembly includes a housing including a front end and a rear end having an opening into a cavity. The housing is formed from first and second shells mating together along an interface that extends along a portion of the shells. The first and second shells form the cavity therebetween that extends along a length of the shells. The cavity is configured to hold an electrical component therein. The module assembly also includes a plurality of slots positioned along a portion of the first shell, and a plurality of pins positioned along a portion of the second shell. The pins are configured to couple with the slots to form a seal along an interface of the shells that shields the electrical component from electromagnetic interference.

DETAILED DESCRIPTION OF THE INVENTION

Embodiments described herein include a connector module assembly that have a housing with shielding elements configured to prevent and/or limit electromagnetic interference (EMI) between the module assemblies and other electronic circuitry. The housing may have a variety of configurations as set forth herein. For example, the module assembly may be a Small Form-factor Pluggable (SFP), XFP, Quad Small Form-factor Pluggable (QSFP), Micro Quad Small Form-factor Pluggable (MicroQSFP) connector, and the like. The module assembly may be used to convey data signals from one electrical device to another, and more particularly to convey data signals at high frequencies, such as 28 gigabits per second (Gbs).

Figure 1:
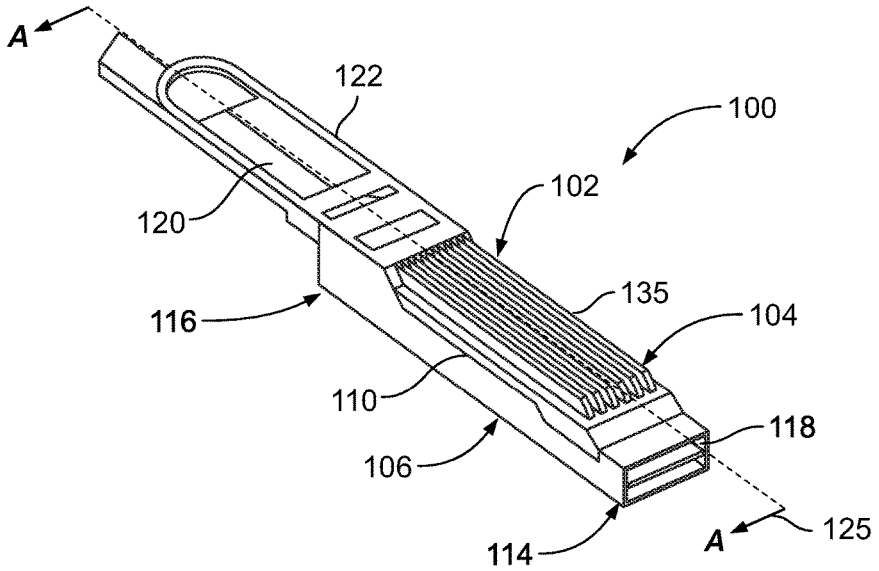
FIG. 1 is a perspective view of an electrical connector module assembly in accordance with an embodiment.

FIG. 1 is a perspective view of an electrical connector module assembly 100 formed in accordance with one embodiment. The module assembly 100 includes a housing 102 that may be formed from two housing shells, an upper shell 104 and a lower shell 106, which mate or engage with each other along interfaces 110, only a portion of which is shown in FIG. 1. The module assembly 100 has a front end 114, a rear end 116, and a cavity 108 (FIG. 2) that extends lengthwise from the front end 114 to the rear end 116. The front end 114 is configured for pluggable insertion into a receptacle assembly (not shown) that is attached to a host electronic system (e.g., computer) or an electronic device (not shown). The front end 114 includes an electrical component, which is illustrated in FIG. 1 as a circuit board 118, configured to couple with the electronic system or device in order to establish an electrical connection. The module assembly 100 also includes a cable 120 that extends into the cavity 108 from the rear end 116 and connects with the circuit board 118 within the housing 102 using one or more conductors (not shown). When in operation, the module assembly 100 may transmit data signals through the cable 120 and corresponding conductors generally along a longitudinal transmission axis 125 and into the circuit board 118, which is engaged within the receptacle assembly.

The module assembly 100 may include a tab 122 that couples to the rear end 116 and facilitates gripping and removing the module assembly 100 from the receptacle assembly. For example, the tab 122 may be coupled to a pair of slidable actuators 124 that include ejector latches 128. The ejector latches 128 engage sides of the receptacle assembly (not shown). When the tab 122 is pulled in a front-to-rear direction, the actuators 124 slide rearward thereby disengaging the latches 128 from the receptacle assembly and allowing the module assembly 100 to be removed.

As will be described in further detail below, embodiments described herein utilize a plurality of shielding elements 300 (FIG. 2) for limiting or preventing electromagnetic interference (EMI) through seams or longitudinal gaps, such as those that may extend along interfaces 110. More specifically, the seams may occur where edges of housing components, such as the upper and lower shells 104 and 106, abut each other. Although the embodiments are described with specific reference to the module assembly 100, the shielding elements 300 may be used with other electrical connectors that include seams or longitudinal gaps and, more specifically, that include seams or longitudinal gaps that extend parallel and adjacent to the transmission axis 125.

Figure 2:
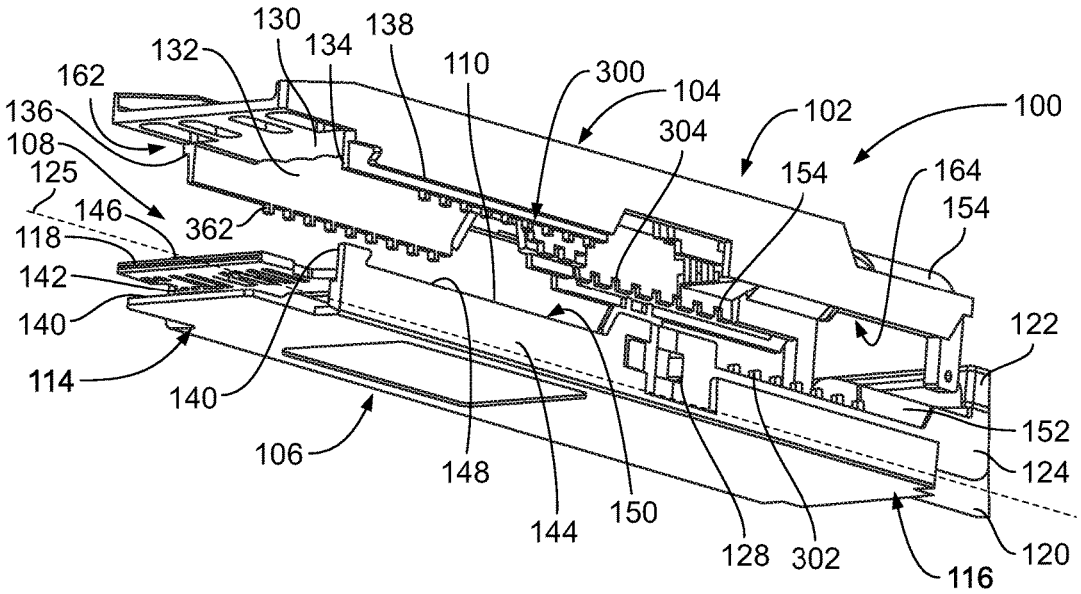
FIG. 2 is a partially exploded perspective view of the electrical connector module assembly in accordance with an embodiment.

FIG. 2 is a partially exploded perspective view of the upper and lower shells 104 and 106 before the upper and lower shells 104 and 106 are mated with each other to form the module assembly 100 (FIG. 1). The upper and lower shells 104 and 106 may have a generally open-faced rectangular shape. More specifically, the upper shell 104 may include an interior wall 130 and opposing sidewalls 132 and 134 that are connected by the interior wall 130, which extends therebetween. In FIG. 2, the opposing sidewalls 132 and 134 form planes that are parallel with respect to each other and extend parallel to the transmission axis 125. However, alternative embodiments may include sidewalls 132 and 134 that are not parallel and do not oppose each other. As shown, the inner surfaces of the interior wall 130 and the sidewalls 132 and 134 form a shell interior surface 162 and lower edges 164. As shown in FIG. 2, the interior wall 130 and the sidewalls 132 and 134 form a channel that generally extends parallel to or along the transmission axis 125. Likewise, the lower shell 106 may include an interior wall 140 and opposing sidewalls 142 and 144 that are connected by the interior wall 140, which extends therebetween. Although not shown, the inner surfaces of the sidewalls 142 and 144 and the interior wall 140 may form an interior surface (not shown) and upper edges 150 that may be similarly shaped to the interior surface 162 and lower edges 164 and also generally extend parallel to or along the transmission axis 125. Also shown in FIG. 2, the upper and lower shells 104 and 106 each include a semi-circular cable extension 152 and 154, respectively, that projects from the rear end 116 of the respective shell. When the cable extensions 152 and 154 are joined together, the cable extensions 152 and 154 form a strain-relief extension that includes an opening (not shown) for receiving the cable 120. Optionally, the upper shell 104 includes fins 135 (FIG. 1) configured to increase the rate of heat transfer of the module assembly and dissipate heat from the module assembly 100 to the surrounding atmosphere.

Although the interior surface 162 has a rectangular shape in FIG. 2, the interior surface 162 may have other shapes or configurations. For example, the interior wall 130 may be semi-circular (concave or convex) or shaped like a trough instead of being substantially planar. Also, the sidewalls 132 and 134 may form a non-orthogonal angle with respect to the interior wall 130 instead of a perpendicular angle as shown in FIG. 2.

Figure 3A:
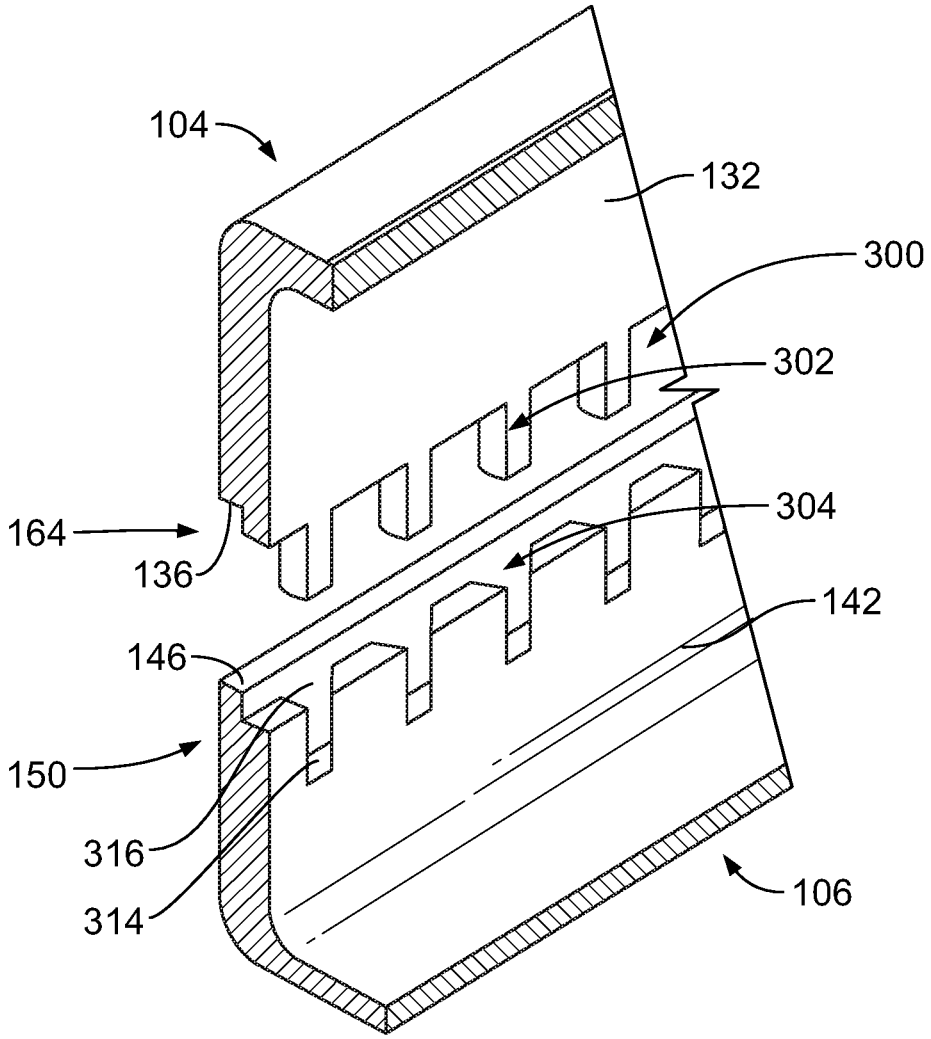
FIG. 3A is an enlarged partial exploded perspective view of electrical connector module assembly.
Figure 3B:
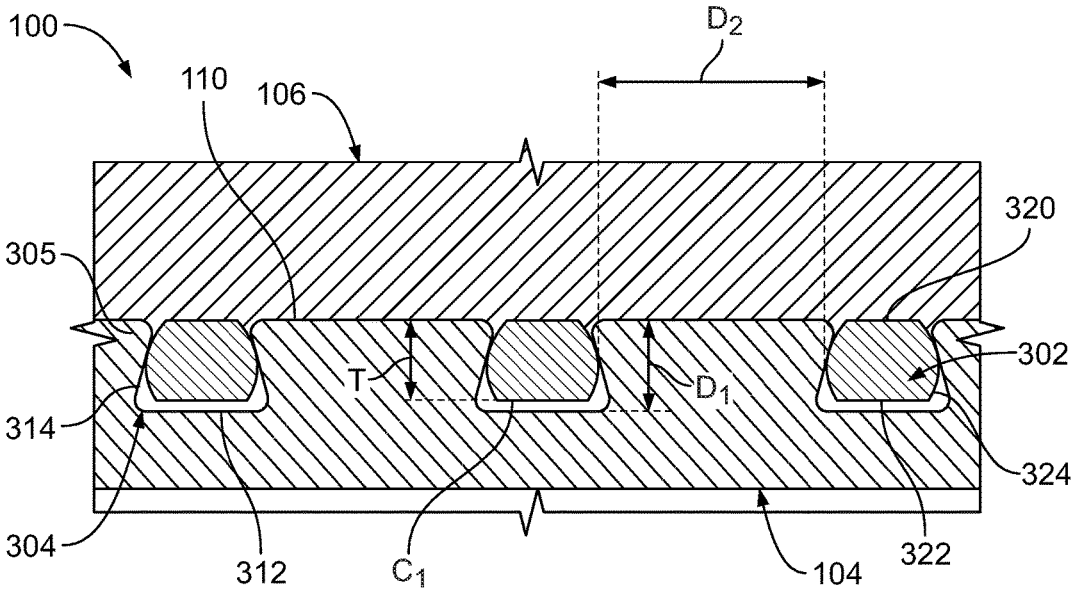
FIG. 3B is an enlarged partial cross-section view of the electrical connector module assembly taken along A-A shown in FIG. 1 formed in accordance with an embodiment.

FIG. 3A is an enlarged partial exploded perspective view of electrical connector module assembly 100. FIG. 3B is an enlarged partial cross-section view of the electrical connector module assembly 100 taken along A-A shown in FIG. 1 formed in accordance with an embodiment. The lower edges 164 of the sidewalls 132 and 134 each have a mating surface 136 and 138 positioned along a posterior portion of the lower edges 164, respectively, and the upper edges 150 of the sidewalls 142 and 144 each have a mating surface 146 and 148 positioned along a posterior portion of the upper edge 150, respectively. The mating surfaces 136 and 138 and the mating surfaces 146 and 148 are conformed to mate or engage with each other when the module assembly 100 (FIG. 1) is formed and may include substantially planar surfaces that abut each other when the upper and lower shells 104 and 106 are mated together. When the module assembly 100 is formed, the upper shell 104 is lowered onto the lower shell 106 such that the mating surfaces 136 and 146 and the mating surfaces 138 and 148 seat against each other.

In order to limit or prevent EMI between the module assembly 100 and other electronic circuitry, the upper and lower shells 104 and 106 include shielding elements 300 positioned along an anterior portion of the lower edges 164 of the upper shell 104 and the upper edges 150 of the lower shell 106. As shown in the embodiments of FIGS. 1-4, the shielding elements 300 are positioned anterior to the mating surfaces 136, 138, 146, 148. Optionally, at least a portion of the shielding elements 300 may be positioned posterior to the mating surfaces 136, 138, 146, 148.

The shielding elements 300 may include a plurality of pins 302 and a plurality of slots 304 configured for mating to form interfaces 110 between the upper and lower shells 104 and 106 (FIG. 3B). A first set of pins 302 extends downwardly from the sidewalls 132 and 134 along a first or front portion of the upper shell 104 (FIG. 2). A first or front set of slots 304 extend downwardly into the sidewalls 142 and 144 along a first or front portion of the lower shell 106. A second or rear set of pins 302 extends upwardly from the sidewalls 142 and 144 along a second or rear portion of the lower shell 106. A second or rear set of slots 304 extend upwardly into the sidewalls 132 and 134 of the upper shell 104 along a second or rear portion of the upper shell 104. Optionally, the pins 302 and slots 304 can be positioned along the sidewalls 132, 134, 142, 144 of the upper and lower shells 104 and 106 in any configuration. For example, the pins 302 can be positioned along the entire length or a portion of the sidewalls 132 and 134 of the upper shell 104, and corresponding slots 304 positioned along the entire length or a portion of the sidewalls 142 and 144 of the lower shell 106. Alternatively, the pins 302 can be positioned along the entire length or a portion of the sidewalls 142 and 144 of the lower shell 106, and corresponding slots 304 positioned along the entire length or a portion of the sidewalls 132 and 134 of the upper shell 104. In another embodiment, the pins 302 and slots 304 can be positioned in an alternating or variable pattern along the entire length or a portion(s) of the sidewalls 132 and 134 of the upper shell 104, and a corresponding alternating or variable pattern along the entire length or a portion(s) of the sidewalls 142 and 144 of the lower shell 106. In alternative embodiments, the shielding elements may be placed anywhere along the upper and lower shells 104 and 106 provided that the shielding elements 300 may function as described herein.

The sidewalls 132, 134, 142, 144 define angled non-perpendicular slots 304, with each slot having and slot sidewalls 310 connected by an interior wall 312 extending therebetween. For example, each slot 304 can define a generally trapezoid shaped channel 314 having an opening 316. Optionally, each slot 304 has opposing inwardly tapered slot sidewalls 310 connected by a planar interior wall 312. The side walls 310 may be positioned at an acute angle relative to the interior wall 312, such as about 60° to about 80°. The opening 316 of the channel 314 may be a predetermined width, such as about 0.5 millimeters, although other widths can be used.

The sidewalls 132, 134, 142, 144 define pins 302 with each pin having an interior surface 320, an exterior surface 322, connected by side surfaces 324 extending therebetween. The pins 302 are configured to insert into the channels 314 of corresponding slots 304 with a friction fit to mate the upper and lower shells 104 and 106 and form an EMI seal along the interfaces 110. For example, the interior surface 320 and an exterior surface 322 may be substantially planar and parallel with each other, and the side surfaces 324 arcuate for seating against the tapered slot sidewalls 310 of the slots 304 at points of contact 305. Due to the tapered slot sidewalls 310, the contact between the pins 302 and slots 304 at the points of contact 305 bias the pins 302 towards the interior walls 312. In addition, the curvature of the side surfaces 324 provide for reliable contact of the pins 302 with the slots 304 at the points of contact 305, even with variances in tolerances or defects that may occur during the manufacturing process of the mating elements 300. Accordingly, reliable contact of the mating elements provides a reliable seal of the upper and lower shells 104 and 106 along the interfaces 110.

A thickness T of each pin 302, which is defined as the distance between the interior surface 320 and the exterior surface 322, may be less than a depth $D_1$ of the slot 304, which is defined as the distance between the interior wall 312 and the opening 316, to provide a clearance $C_1$ between the exterior surface 322 of the pin 302 and the interior wall 312 of the slot 304. For example, the clearance $C_1$ allows space for biasing the pin 302 towards the interior wall 312 of the slot 304 and variances in tolerances or defects that may occur during the manufacturing process of the mating elements 300. The pins 302 are positioned at a predetermined distance $D_2$ to provide a reliable seal along the interface 110, and to prevent the sidewalls 132, 134, 142, and 144 from bowing or separating. For example, the pins 302 can be positioned at a distance of 2 millimeters or less to ensure reliable points of contact at multiple points along the portion of the upper and lower shells 104 and 106 for EMI shielding along the interfaces 110. A distance of greater than 2 millimeters may allow gaps or areas of separation along the interface 110 that compromise the EMI seal. For example, variances in tolerances, defects, may negatively affect the fit, such as causing bowing or separation of the sidewalls between the sidewalls 132, 134, 142, and 144. Positioning enough mated pins 302 and slots 304 at suitable distances along the sidewalls 132, 134, 142, and 144 can prevent such bowing or separation.

Figure 4:
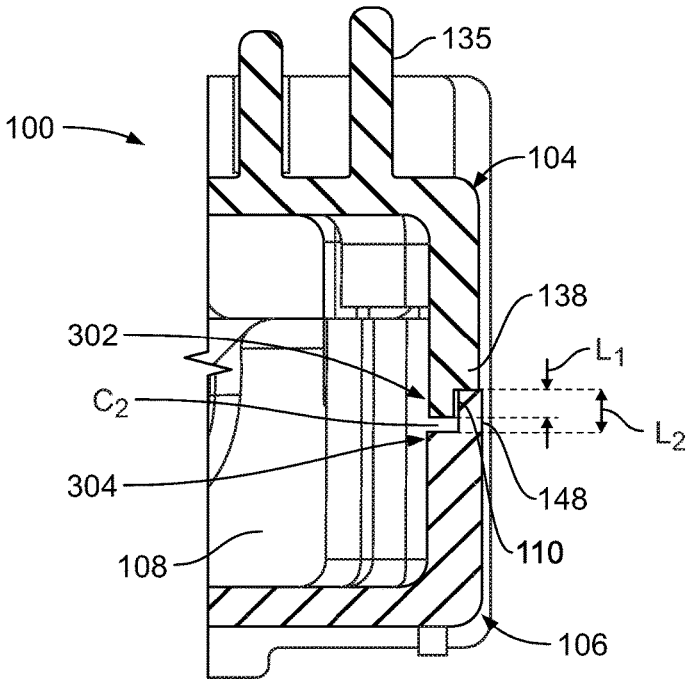
FIG. 4 is a partial cross-section of the electrical connector module assembly in accordance with an embodiment.

FIG. 4 is a partial cross-section of the electrical connector module assembly in accordance with an embodiment. A length $L_1$ of each pin 302, which is defined as the distance from a base of the pin 302 to the tip of the pin 302, may be less than a length $L_2$ of the slot 304, which is defined as the distance between the base of the slot 304 to an upper opening of the slot 304 to provide a clearance $C_2$ between the tip of the pin 302 and the base of the slot 304. For example, the clearance $C_2$ provides space for insertion of the pins 302 into the slots 304 until the mating surfaces 136, 138, and mating surfaces 146, 148 mate or engage with each other.

For example, the plurality of pins 302 insert into the corresponding plurality of slots 304 until the mating surfaces 136 and 138 and the mating surfaces 146 and 148 are seated against each other. When the module assembly 100 is formed, the lower shell 106 is lowered onto the upper shell 104 such that the mating surfaces 136 and 138 and mating surfaces 146 and 148 mate or engage with each other.

In various embodiments, the upper and lower shells 104 and 106 may be stamped, forged, molded, or otherwise formed from a material that limits or prevents the transmission of EMI and/or electromagnetic radiation through the housing 102. For example, the upper and lower shells 104 and 106 may be manufactured from a material having high electromagnetic radiation absorbing characteristics, such as, a low magnetic permeability factor or a low electric permittivity factor. The upper and lower shells 104 and 106 may be made from a metal, dielectric material, including, but not limited to stainless steel, copper, aluminum, alloys, composite materials, and the like. Optionally, the material may be a conductive impregnated dielectric material that dissipates substantially all of the electromagnetic radiation by reflecting, scattering, and/or diffusing the electromagnetic radiation.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed:

1. An electrical connector module assembly, comprising:

a first shell comprising opposing sidewalls and an interior wall extending between the opposing sidewalls, the opposing sidewalls and the interior wall forming a first shell interior surface;

a second shell comprising opposing sidewalls and an interior wall extending between the opposing sidewalls, the opposing sidewalls and the interior wall forming a second shell interior surface, the second shell configured to mate together with the first shell along an interface that extends along a portion of the shells, the first and second shells forming a cavity therebetween that extends along a length of the shells, the cavity configured to hold an electrical component therein; and a plurality of shielding elements positioned along the portion of the shells, the shielding elements configured to form a seal along the interface that shields the electrical component from electromagnetic interference, wherein the plurality of shielding elements are configured to form the seal along the first shell interior surface and the second shell interior surface inside the electrical connector module assembly.

2. The module assembly of claim 1, the plurality of shielding elements comprising:

a plurality of slots, each slot having inwardly tapered sidewalls connected by an interior wall; and a plurality of pins, each pin having arcuate side surfaces configured to mate with the tapered sidewalls of a corresponding slot at a point of contact.

3. The module assembly of claim 2, wherein the sidewalls of each slot bias the corresponding pin towards the interior wall of the slot.

4. The module assembly of claim 2, wherein the sidewalls of each slot are positioned at an angle of about 60° to about 80° relative to the interior wall.

5. The module assembly of claim 2, wherein each pin includes a planar interior surface and a planar exterior surface.

6. The module assembly in accordance with claim 2, comprising:

a second plurality of slots positioned along a second portion of the first shell; and a second plurality of pins positioned along a second portion of the second shell.

7. The module assembly of claim 1, wherein the plurality of pins are spaced apart from each other by a distance of about 2 millimeters or less.

8. The module assembly of claim 1, the first shell having a first mating surface extending the length of the first shell; and the second shell having a second mating surface extending the length of the second shell and configured for mating with the first mating surface.

9. The module assembly of claim 8, wherein the first mating surface and second mating surface are positioned posterior to the pins.

10. The module assembly of claim 1, wherein the first and second shells comprise a material configured to block electromagnetic interference from entering the assembly.

11. An electrical connector module assembly comprising:

a housing including a front end and a rear end having an opening into a cavity, the housing formed from first and second shells mating together along an interface that extends along a portion of the shells, the first shell comprising opposing sidewalls and an interior wall extending between the opposing sidewalls, the opposing sidewalls and the interior wall forming a first shell interior surface, the second shell comprising opposing sidewalls and an interior wall extending between the opposing sidewalls, the opposing sidewalls and the interior wall forming a second shell interior surface, the first and second shells forming the cavity therebetween that extends along a length of the shells, the cavity configured to hold an electrical component therein;

a plurality of slots positioned along a first portion of the first shell; and a plurality of pins positioned along a first portion of the second shell, the pins configured to couple with the slots to form a seal along the interface of the shells that shields the electrical component from electromagnetic interference, wherein the plurality of slots and the plurality of pins are configured to form the seal along the first shell interior surface and the second shell interior surface inside the electrical connector module assembly.

12. The module assembly of claim 11, wherein each slot includes inwardly tapered sidewalls connected by an interior wall; and each pin includes arcuate side surfaces configured to mate with the tapered sidewalls of a corresponding slot at a point of contact.

13. The module assembly of claim 12, wherein the sidewalls of each slot bias the corresponding pin towards the interior wall of the slot.

14. The module assembly of claim 12, wherein the sidewalls of each slot are positioned at an angle of about 60°-80° relative to the interior wall.

15. The module assembly of claim 12, wherein each pin includes a planar interior surface and a planar exterior surface.

16. The module assembly of claim 11, wherein the plurality of pins are spaced apart from each other by a distance of about 2 millimeters or less.

17. The module assembly of claim 11, wherein the first shell includes a first mating surface extending a first portion of the first shell; and the second shell includes a second mating surface extending a second portion of the second shell and configured for mating with the first mating surface.

18. The module assembly of claim 17, wherein the first mating surface and second mating surface are positioned posterior to the pins.

19. The module assembly of claim 11, wherein the first and second shells comprise a material configured to block electromagnetic interference from entering the assembly.

20. The module assembly of claim 11, comprising:

a second plurality of slots positioned along a second portion of the first shell; and a second plurality of pins positioned along a second portion of the second shell.

* * * * *